US008091257B2

(12) United States Patent
Aiura

(10) Patent No.: US 8,091,257 B2
(45) Date of Patent: Jan. 10, 2012

(54) STEAM IRON WITH ACCELERATION AND TILT DETECTION

(75) Inventor: Masami Aiura, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 409 days.

(21) Appl. No.: 12/414,700

(22) Filed: Mar. 31, 2009

(65) Prior Publication Data

US 2010/0242314 A1 Sep. 30, 2010

(51) Int. Cl.
*D06F 75/24* (2006.01)
*D06F 75/00* (2006.01)

(52) U.S. Cl. ..... 38/77.7

(58) Field of Classification Search ..... 38/74–77.82; 219/245–270
See application file for complete search history.

(56) References Cited

U.S. PATENT DOCUMENTS

| | | | | |
|---|---|---|---|---|
| 4,686,352 | A * | 8/1987 | Nawrot et al. | 219/250 |
| 6,318,009 | B1 | 11/2001 | De Maneville et al. | |
| 6,463,685 | B1 | 10/2002 | Tynes | |
| 6,548,785 | B1 * | 4/2003 | Rius et al. | 219/248 |
| 6,720,537 | B2 * | 4/2004 | Prager | 219/506 |
| 6,748,680 | B2 | 6/2004 | Pahlke et al. | |
| 6,802,141 | B2 | 10/2004 | Walther | |
| 7,360,328 | B2 | 4/2008 | Fung | |
| 7,610,701 | B2 * | 11/2009 | Cavada | 38/82 |
| 2004/0025382 | A1 | 2/2004 | Walther | |
| 2006/0081589 | A1 * | 4/2006 | Chi-Ting et al. | 219/248 |
| 2007/0220784 | A1 | 9/2007 | Li | |

FOREIGN PATENT DOCUMENTS

| | | | |
|---|---|---|---|
| JP | 405076700 | A * | 3/1993 |
| JP | 1994055599 | A | 3/1994 |
| JP | 406327900 | A * | 11/1994 |
| JP | 2007089641 | A | 4/2007 |
| WO | WO2005014917 | A1 | 2/2005 |

OTHER PUBLICATIONS

Cambridge Consultants, Getting a good press, http://www.eurekamagazine.co.uk/article/9664/Gefting-a-good-press.aspx.
Cambridge Consultants, Technology creates the world's "smartest" iron, http://www.cambridgeconsultants.com/news_pr138.html.

* cited by examiner

*Primary Examiner* — Ismael Izaguirre
(74) *Attorney, Agent, or Firm* — Charles Bergere

(57) ABSTRACT

A steam iron includes a sensor for detecting and measuring movement of the steam iron. The sensor is coupled to an actuator that regulates the flow of steam via a valve located between a steam chamber and steam outlets. The sensor can detect movement in three directions (X, Y, Z) and adjust steam generation based on speed of movement of the iron and tilt angle. A pre-heater is used to pre-heat water in a water chamber. The pre-heated water is provided to a steam chamber where it is later converted to steam.

15 Claims, 2 Drawing Sheets

STEAM IRON WITH ACCELERATION AND TILT DETECTION

BACKGROUND OF THE INVENTION

The present invention relates to steam irons and more particularly to steam iron with controlled water flow and steam generation.

Steam irons are well known and have been in use for many years. Such irons have a handle and a base. The base includes a water reservoir, a steam chamber in fluid communication with the water reservoir, a heating element, and a base plate having a number of steam spray ports therein. Typically, the heating element heats water in the steam chamber to generate steam that may be expelled from the base plates via the steam spray ports in response to the user pressing a button. Thus, the amount of steam released from the iron depends in large part on the user. If the user presses the button for a prolonged period of time, all of the steam will be expelled from the steam chamber.

It would be advantageous to have a steam iron that can automatically control the generation and flow of steam.

BRIEF DESCRIPTION OF THE DRAWINGS

The following detailed description of preferred embodiments of the invention will be better understood when read in conjunction with the appended drawings. The present invention is illustrated by way of example and is not limited by the accompanying figures, in which like references indicate similar elements. It is to be understood that the drawings are not to scale and have been simplified for ease of understanding the invention.

DETAILED DESCRIPTION OF THE INVENTION

Figure 1:
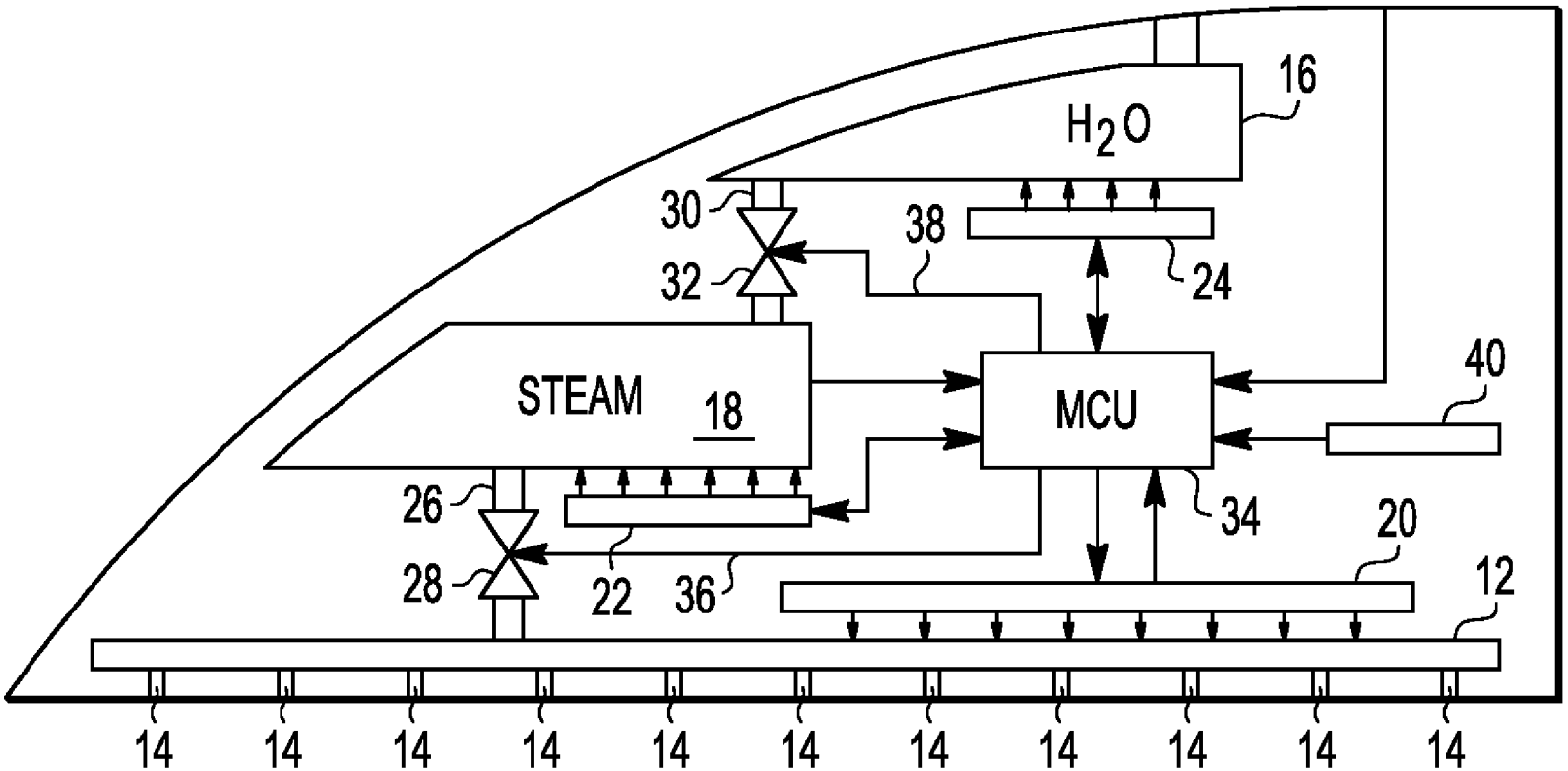
FIG. 1 is a side, cross-sectional view of a steam iron in accordance with one embodiment of the invention.

The detailed description set forth below in connection with the appended drawings is intended as a description of a presently preferred embodiment of the invention, and is not intended to represent the only form in which the present invention may be practiced. It is to be understood that the same or equivalent functions may be accomplished by different embodiments that are intended to be encompassed within the spirit and scope of the invention. In the drawings, like numerals are used to indicate like elements throughout.

In one embodiment, the present invention provides a steam iron including a heatable base plate having a plurality of steam outlets. A reservoir is provided for holding water and steam. A heating element is located near to the base plate and the reservoir for heating the base plate and for heating water in the reservoir and converting the water to steam. At least one steam pipe connects the base plate steam outlets with the reservoir that allows steam to move from the reservoir to the steam outlets and exit the iron. A first valve is located along the steam pipe between the reservoir and the steam outlets for regulating the flow of steam through the steam pipe. Steam may move from the reservoir to the steam outlets when the first valve is in an open position. A first actuator moves the first valve between the open position and a closed position. A sensor, coupled to the actuator, detects and measures a speed of movement of the steam iron. The actuator moves the first valve between the open and closed positions depending on the detected speed of movement.

In another embodiment, the sensor is three axis accelerometer that detects both speed and tilt angle of the steam iron and the actuator is a microcontroller that moves the valve between the open and closed positions depending on either or both of the speed of movement and the tilt angle of the steam iron. When the steam iron is moved at a predetermined speed and at a predetermined angle, steam is automatically expelled via the steam outlets.

A steam iron 10 in accordance with various embodiments of the present invention now will be described with reference to FIG. 1. The steam iron 10 has a heatable base plate 12 having a plurality of steam spray ports or outlets 14 therein. A reservoir is provided for holding water and steam. In one embodiment of the invention, the reservoir comprises a water reservoir 16 for holding water and a steam chamber 18 for holding steam. The water reservoir 16 is in fluid communication with the steam chamber 18. The base plate 12, steam outlets 14, water reservoir 16 and steam chamber 18 are all well known elements of a steam iron to those of skill in the art and a detailed description is not required for a complete understanding of the invention. Further, although the water reservoir 16 and steam chamber 18 are shown as in the drawing as separate elements at particular locations and of particular size and shape, in fact, these elements may comprise various numbers, sizes, shapes and locations, and the present invention should not be limited by such features of these elements.

The iron 10 includes a heating element for heating water in the water reservoir 16 and converting the water to steam, and heating the base plate 12. In one embodiment of the invention, the heating element comprises at least two heating elements. A first heating element 20 is located proximate to or integral with the base plate 12 for heating the base plate 12. A second heating element 22 is located proximate to or integral with the steam chamber 18 for converting water in the steam chamber to steam. In another embodiment of the present invention, a pre-heating element 24 is located proximate to or integral with the water reservoir 16 for pre-heating the water stored in the water reservoir 16. Although the heating elements 20, 22 and 24 are shown as adjacent to the base plate 12, steam chamber 18 and water reservoir 16, respectively, it will be understood by those of skill in the art that the heating elements may comprise various types of heating elements and be located at several different positions, such as adjacent to, near to, or integral with the base plate 12, water reservoir 16, and steam chamber 18, respectively. Thus, the present invention should not be limited by the type, number, or location of the heating elements.

At least one steam pipe 26 connects the base plate steam outlets 14 with the steam chamber 18 and allows steam in the steam chamber 18 to move to the steam outlets 14 and exit or be sprayed from the iron 10. A first valve 28 is located along the steam pipe 26 between the steam chamber 18 and the steam outlets 14 for regulating the flow of steam through the steam pipe 26. When the first valve 28 is in an open position, steam may move from the steam chamber 18 to the steam outlets 14, and when the first valve 28 is in a closed position, steam may not traverse the steam pipe 26. Although only one steam pipe 26 and first valve 28 are shown, the steam iron 10 may have more than one steam pipe 26 that connects the steam chamber 18 with the steam outlets 14.

In one embodiment of the invention, the steam iron 10 also includes a water pipe 30 connecting the water reservoir 16 with the steam chamber 18. A second valve 32 is located along the water pipe 30 for regulating the flow of liquid between the water reservoir 16 and the steam chamber 18. When the second valve 32 is in an open position, liquid stored in the water reservoir 16 may move to steam chamber 18, and when the second valve 32 is in a closed position, liquid may not traverse the water pipe 30. Although only one water pipe 30 and second valve 32 are shown, the steam iron 10 may have more than one water pipe 30 that connects the water reservoir 16 with the steam chamber 18.

In one embodiment of the invention, the steam iron 10 includes first and second actuators for moving the first and second valves 28 and 32, respectively, between their respective open and closed positions. In one embodiment of the invention, the first and second actuators comprise a microcontroller 34 that is electrically connected to the first and second valves 28 and 32, and sends respective first and second actuator signals 36 and 38 to the first and second valves 28 and 32 to move the first and second valves 28, 32 between their open and closed positions.

A sensor 40 is coupled to the microcontroller 34 for detecting and measuring a speed of movement of the steam iron 10. The sensor 10 sends the measured speed data to the microcontroller 34 and the microcontroller 34 generates the first actuator signal 36, to move the first valve 38 between the open and closed positions, depending on the detected speed of movement. In one embodiment of the present invention, the sensor 40 comprises an accelerometer, such as a 3-axis accelerometer that can measure both speed and tilt angle of the steam iron 10. In such embodiment, the microcontroller 24 receives the measured speed and tilt data from the sensor 40 and generates the first and second actuator signals 36, 38, for moving the first and second valves 28, 32 between their open and closed positions. The generation of steam and the flow of liquid between the water reservoir 16, the steam chamber 18 and the base plate steam outlets 14 are thus controlled.

The sensor 40 may comprise a Micro-electromechanical system (MEMS) sensor. MEMS dual axis accelerometers are presently available in small packages, on the order of 4 mm×4 mm×1.5 mm. Such devices operate on power supplies around 3v and provide signal conditioned voltage outputs for a variety of motion sensing, tilt sensing and inertial sensing features. For example, small tilt changes can be sensed using narrow bandwidths. Example MEMS sensors that may be used to realize the present invention are Freescale Semiconductor, Inc.'s MMA7455L and MMA7456L accelerometers, which can be used for sophisticated portable electronics products.

The speed and tilt data provided by the sensor 40 to the microcontroller 34 are used as further described herein. In one embodiment, when the iron 10 moves faster than a first predetermined speed, the controller 34 generates the first actuator signal 36 to move the first valve 28 from its closed position to its open position. This would be the case for when the iron 10 is in a steam mode and a user is moving the iron 10 back and forth over an item to be ironed. The sensor 40 detects the movement speed of the iron 10 and sprays steam stored in the steam chamber 18 by way of the steam outlets 14 by causing the first valve 28 to be opened. Conversely, when the iron 10 moves slower than the first predetermined speed, the first valve 28 is moved from the open position to the closed position.

As discussed above, in addition to measuring speed of movement, the sensor 40 can also detect and measure tilt angles. Such tilt angle data is provided from the sensor 40 to the controller 34. In turn, the controller 34 causes the first valve 28 to move between the open and closed positions depending on the detected tilt angle. In one embodiment of the invention, the first valve 28 is closed when a tilt angle of the steam iron 10 is about 90° (e.g., 90°±10°). That is, the user has placed the iron 10 in an upright or erect position, such as that shown in FIG. 2A. In another embodiment of the invention, the first valve 28 is closed when a tilt angle of the steam iron 10 is greater than about 20° (e.g., 20°±10°), as shown in FIG. 2D.

Figures 2A, 2B, 2C, 2D:
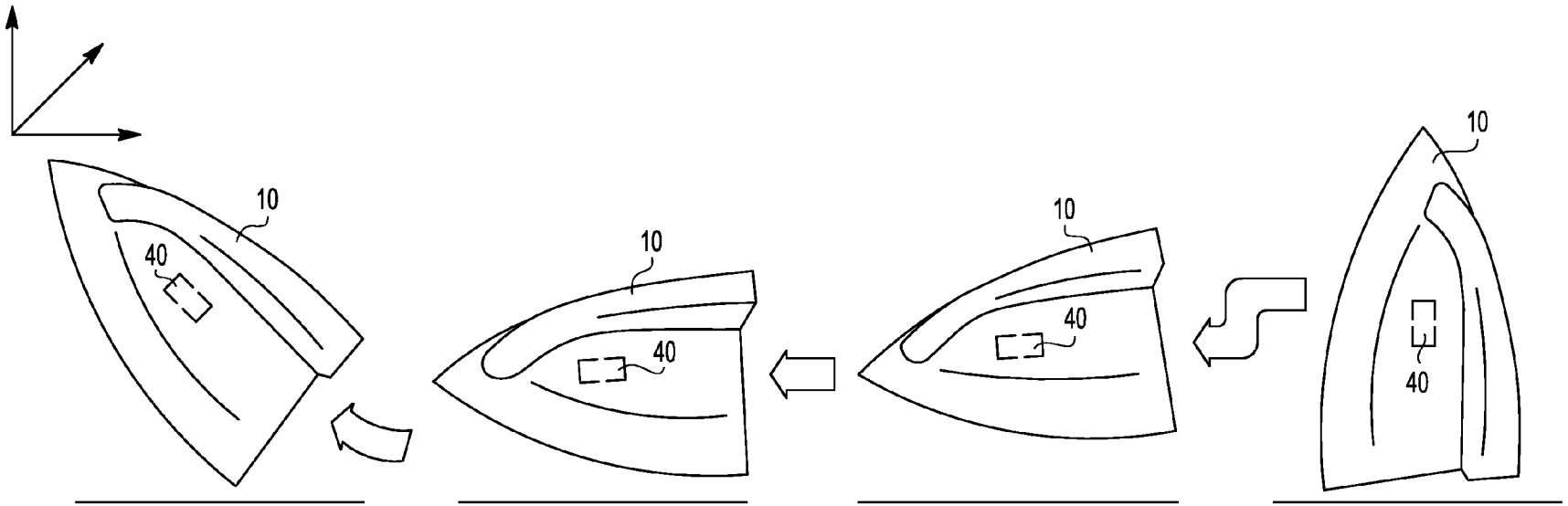
FIGS. 2A-2D illustrate the operation of a steam iron in accordance with an embodiment of the present invention.

Referring now to FIGS. 2A-2D, the operation of the steam iron 10 is shown. FIG. 2A shows the steam iron 10 in an upright or erect position. The iron 10 would be in such position, for example, before or after use, or when the user is taking a break or re-positioning the item being ironed. When the iron 10 is in the upright position (i.e., the tilt angle is about 90°, as detected by the sensor 40), the first valve 28 is maintained in the closed position.

FIGS. 2B and 2C show the iron 10 in a flat or in-use position (i.e., the tilt angle is close to 0°, as detected by the sensor 40). In such case, the sensor 40 also measures the speed at which the iron is being moved, either forward or backward, and can cause steam to be sprayed out of the steam outlets 14. That is, the tilt angle and speed data are provided from the sensor 40 to the controller 34 and the controller 34 causes the first valve 28 to be opened (or closed as the case may be).

FIG. 2D shows the steam iron 10 being lifted or moved from a relatively flat, in-use position, to an upright position. When the iron 10 is at an angle of greater than about 10°, the controller 34 causes the first valve 28 to be closed.

The iron 10 may include additional features. For example, temperature information may be passed from the heating elements 20, 22 and 24 to the controller 34 so that optimal temperatures thereof may be maintained. Temperature sensors and their interconnection to a microcontroller are well understood by those of skill in the art. In addition, water and steam level information may be passed to the microcontroller 34 so that liquid may be moved from the water reservoir 16 to the steam chamber 18 whenever the steam chamber 18 is low on steam or needs additional steam to maintain enough pressure to eject steam out the steam ports 14.

As is evident from the foregoing discussion, the present invention provides a steam iron with improved steam flow control. By incorporating a three-axis accelerometer, both motion and tilt angle information can be detected and provided to a controller that regulates the production and flow of steam. For example, when the iron is moved from an upright position to an in-use position, steam production may be commenced and when the iron is moved from the in-use position to the upright position, steam production may be inhibited. Additionally, steam generation and ejection can be based on the speed and direction of movement of the iron when in the in-use position. As will be understood by those of skill in the art, the first and second valves 28 and 32 may be opened and/or closed based on other factors not discussed herein, yet not required for a complete understanding of the present invention.

The description of the preferred embodiments of the present invention have been presented for purposes of illustration and description, but are not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiments disclosed, but covers modifications within the spirit and scope of the present invention as defined by the appended claims.

The invention claimed is:

1. A steam iron, comprising:

a heatable base plate having a plurality of steam outlets therein;

a reservoir for holding water and steam;

a heating element for heating water in the reservoir and converting the water to steam, and heating the base plate;

at least one steam pipe connecting the base plate steam outlets with the reservoir, wherein steam moves from the reservoir to the steam outlets and exits the iron therefrom;

a first valve located along the steam pipe between the reservoir and the steam outlets for regulating the flow of steam through the steam pipe, wherein steam may move from the reservoir to the steam outlets when the first valve is in an open position;

a first actuator for moving the first valve between the open position and a closed position; and a sensor, coupled to the actuator, for detecting and measuring a speed of movement of the steam iron, wherein the first valve is moved between the open and closed positions depending on the detected speed of movement, and wherein the sensor comprises a 3-axis accelerometer that measures both speed and tilt angle of the steam iron and wherein the first actuator moves the valve to the closed position when a tilt angle of the steam iron is greater than about 20°.

2. The steam iron of claim 1, wherein when the iron moves faster than a first predetermined speed, the first actuator moves the first valve from a closed position to the open position.

3. The steam iron of claim 2, wherein when the iron moves slower than the first predetermined speed, the first actuator moves the first valve from the open position to the closed position.

4. The steam iron of claim 1, wherein the first valve is moved between the open and closed positions depending on the detected speed of movement and tilt angle.

5. The steam iron of claim 1, wherein the first actuator moves the valve to the closed position when a tilt angle of the steam iron is about 90°.

6. The steam iron of claim 1, wherein the first actuator comprises a controller connected between the sensor and the first valve, wherein the controller receives the measured speed and tilt angle from the sensor and generates a first actuator signal that moves the first valve between the open and closed positions.

7. The steam iron of claim 1, wherein the reservoir comprises at least one water reservoir and at least one steam chamber in fluid communication with the at least one water reservoir, the steam iron further comprising:

a water pipe connecting the at least one water reservoir with the steam chamber;

a second valve located along the water pipe for regulating the flow of liquid between the at least one water reservoir and the steam chamber, wherein liquid may move from the water reservoir to the steam chamber when the second valve is in an open position; and wherein the controller also is connected to the second valve and generates a second actuator signal for moving the second valve between an open position and a closed position.

8. The steam iron of claim 1, wherein the heating element comprises at least two heating elements, a first one of the heating elements for heating the base plate and a second one of the heating elements for heating the steam chamber to convert water in the steam chamber from water to steam.

9. A steam iron, comprising:

a base plate having a plurality of steam outlets therein;

a first heating element proximate to the base plate for heating the base plate;

a water reservoir for holding water;

a pre-heating element proximate to the water reservoir for pre-heating water in the water reservoir;

a steam chamber for holding steam, wherein the steam chamber is in fluid communication with the water reservoir;

a second heating element for heating water in the steam chamber and converting the water to steam;

a steam pipe connecting the base plate steam outlets with the steam chamber, wherein steam moves from the steam chamber to the steam outlets and exits the iron therefrom;

a first valve located along the steam pipe between the steam chamber and the steam outlets for regulating the flow of steam through the steam pipe, wherein steam may move from the steam chamber to the steam outlets when the first valve is in an open position;

a first actuator connected to the first valve for moving the first valve between the open position and a closed position;

a water pipe connecting the water reservoir with the steam chamber, wherein the water pipe allows liquid to flow from the water reservoir to the steam chamber;

a second valve located along the water pipe for regulating the flow of liquid therebetween, wherein liquid may move from the water reservoir to the steam chamber when the second valve is in an open position;

a second actuator connected to the second valve for moving the second valve between the open position and a closed position; and a sensor for detecting and measuring a speed of movement of the steam iron and a tilt angle of the steam iron;

wherein the first and second actuators receive the speed and tilt data from the sensor and generate respective first and second actuator signals therefrom for moving the first and second valves between their open and closed positions, whereby the generation of steam and the flow of liquid between the water reservoir, the steam chamber and the base plate steam outlets are controlled.

10. The steam iron of claim 9, wherein the sensor comprises a MEMS type 3-axis accelerometer and the first and second actuators comprise a microcontroller connected to the sensor for receiving the speed and tilt data and generating the first and second actuator signals.

11. The steam iron of claim 10, wherein when the iron moves faster than a first predetermined speed, the first actuator moves the first valve from a closed position to the open position.

12. The steam iron of claim 11, wherein when the iron moves slower than the first predetermined speed, the first actuator moves the first valve from the open position to the closed position.

13. The steam iron of claim 9, wherein the first valve is moved between the open and closed positions depending on the detected speed of movement and tilt angle.

14. The steam iron of claim 9, wherein the first actuator moves the first valve to the closed position when a tilt angle of the steam iron is greater than about 20°.

15. A steam iron, comprising:

a heatable base plate having a plurality of steam outlets therein;

a water reservoir for holding water;

a steam chamber for holding steam, wherein the steam chamber is in fluid communication with the water reservoir;

a first heating element for heating water in the steam chamber and converting the water to steam;

a second heating element electrically connected to the controller for heating the base plate;

a pre-heating element electrically connected to the controller for pre-heating water in the water reservoir;

a steam pipe connecting the base plate steam outlets with the steam chamber, wherein steam moves from the steam chamber to the steam outlets and exits the iron therefrom;

a first valve located along the steam pipe between the steam chamber and the steam outlets for regulating the flow of steam through the steam pipe, wherein steam may move from the steam chamber to the steam outlets when the first valve is in an open position;

a water pipe connecting the water reservoir with the steam chamber, wherein the water pipe allows liquid to flow from the water reservoir to the steam chamber;

a second valve located along the water pipe for regulating the flow of liquid therebetween, wherein liquid may move from the water reservoir to the steam chamber when the second valve is in an open position;

a sensor for detecting and measuring a speed of movement of the steam iron and a tilt angle of the steam iron; and a controller connected between the sensor and the first and second valves, wherein the controller receives the speed and tilt data from the sensor and generates first and second actuator signals therefrom, wherein the first and second actuator signals cause the first and second valves to move between open and closed positions, wherein when the iron moves faster than a first predetermined speed, the first valve is moved from the closed position to the open position, wherein when the iron moves slower than the first predetermined speed, the first valve is moved from the open position to the closed position, and wherein the first valve is moved to the closed position when a tilt angle of the steam iron is greater than about 20°.

* * * * *